US005199533A

United States Patent [19]

Wilke

[11] Patent Number: 5,199,533

[45] Date of Patent: Apr. 6, 1993

[54] LIFT TRUCK

[75] Inventor: Rudeger H. Wilke, Darien, Ill.

[73] Assignee: Savage Bros. Co., Elk Grove Village, Ill.

[21] Appl. No.: 852,014

[22] Filed: Mar. 16, 1992

[51] Int. Cl.[5] ..... B66B 7/02

[52] U.S. Cl. ..... 187/95; 187/9 R

[58] Field of Search ..... 187/95, 9 F, 9 R, 11; 414/630, 631, 490; 212/267, 269; 254/8 B

[56] References Cited

U.S. PATENT DOCUMENTS 3,032,377 5/1962 Blase ..... 187/95

4,944,368 7/1990 Duderstadt ..... 187/9 R 5,100,283 3/1992 Carty ..... 187/11

*Primary Examiner*—Robert P. Olszewski

*Assistant Examiner*—Kenneth Noland

*Attorney, Agent, or Firm*—Paul H. Gallagher

[57] ABSTRACT

A manually movable lift truck including a base and a column, the column including a steel post welded on the steel base, and a steel sleeve slideable on the post. Flat plastic slide pads in the form of sheets are interposed between the post and sleeve, and detachably fixed to the sleeve in the sliding movements of the latter. The slide pads constitute the only bearing means between the post and sleeve.

9 Claims, 1 Drawing Sheet 14
30
5
24
22
56
26
32
38
36
28
18
20
16
52
50
48
42,54
7
46
44
40
10
8
6
55
9
58
34

LIFT TRUCK

BRIEF SUMMARY OF THE INVENTION

The invention resides in the field of equipment for handling materials. A specific example is a manually pushed lift truck, for lifting and transporting a load. Such a truck may be used in a confectionery plant, where a mixing bowl is lifted, pushed to a new location, and emptied.

Such a truck includes a base with a column or mast thereon having lifting arms for picking up the bowl. The column includes a post fixed on the base and a sleeve slidable on the post, the arms being carried by the sleeve.

A broad object of the invention is to provide novel bearing mean between the sleeve and the post.

A more specific object is to provide a column including a post and a sleeve slidable thereon, with a novel construction and arrangement of bearing means between the post and the sleeve, and more particularly such a construction and arrangement that eliminates the requirement for accuracy in dimensions in the post and sleeve.

Still more specifically, another feature of the invention is an arrangement of post and sleeve construction that are polygonal in cross section, having flat sides, and the bearing members are in the form of flat sheets, or pads, positioned between the flat sides of the post and sleeve, resulting in an extremely simple and inexpensive construction.

DETAILED DESCRIPTION

Figures 1, 2, 3, 4, 5, 6, 7, 8, 9, 10, 11:
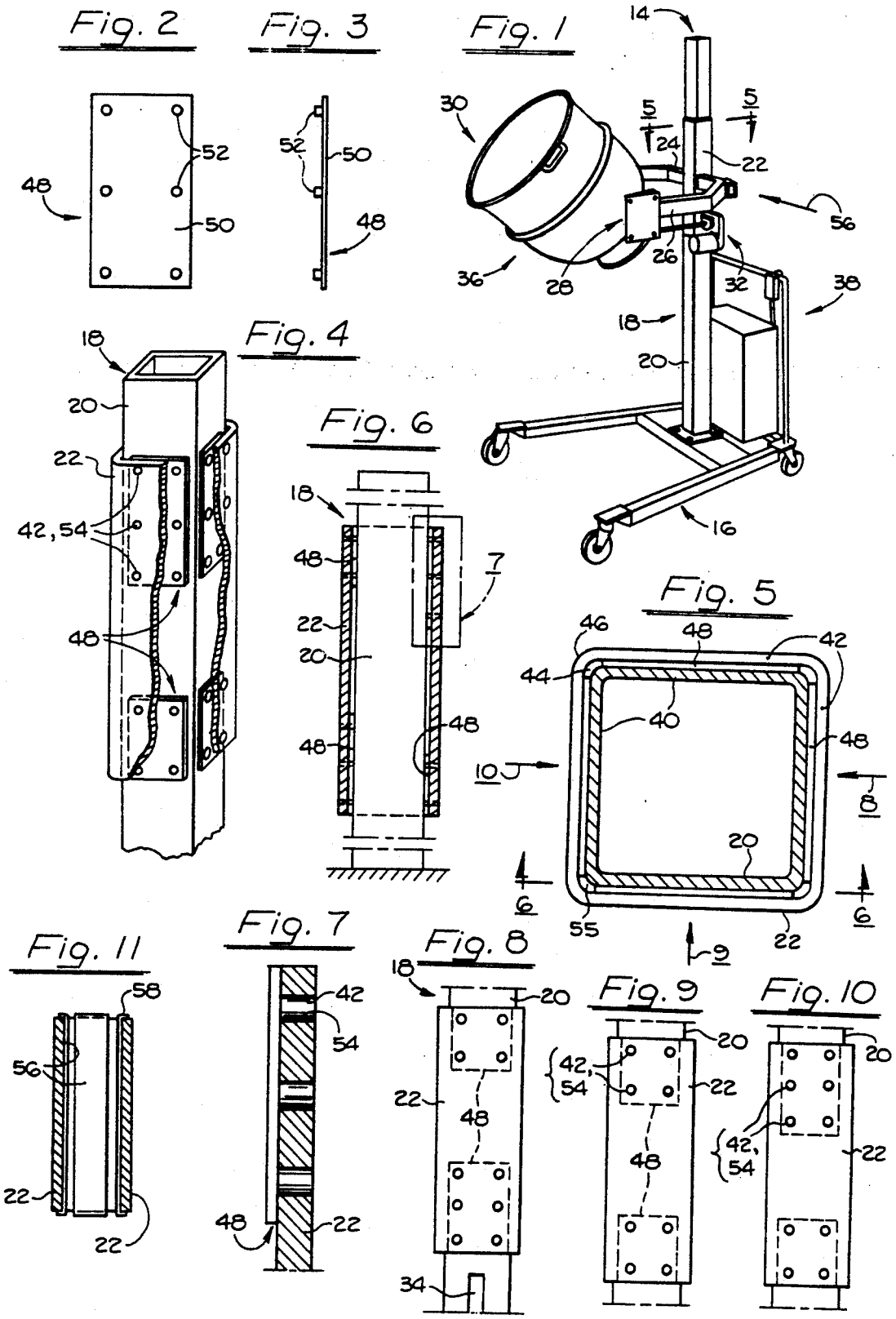
FIG. 1 is perspective view of a lift truck embodying the features of the invention.
FIG. 2 is a face view of one of the bearing sheets.
FIG. 3 is an edge view of the sheet of FIG. 2.
FIG. 4 is a fragmentary perspective view of the sleeve partially broken away, and adjacent portion of the post.
FIG. 5 is a sectional view taken at line 5—5 of FIG. 1.
FIG. 6 is a view taken at line 6—6 of FIG. 5.
FIG. 7 is an enlarged view of that portion of FIG. 6 enclosed in the rectangle 7.
FIG. 8 is a fragmentary view from the rear of the column, oriented according to the arrow 8 of FIG. 5.
FIG. 9 is a partial view of the side of the column oriented according to the arrow 9 of FIG. 5.
FIG. 10 is a partial view from the front, oriented according to the arrow 10 of FIG. 5.
FIG. 11 is a sectional view, oriented according to FIG. 6, showing a modified form of bearing sheets.

Referring in detail to the drawings, FIG. 1 shows a lift truck 14 embodying the features of the invention. The lift truck in its general construction, includes a base 16 having wheels to enable it to be pushed on a supporting floor. Mounted on the base is a column 18 or mast that includes a post 20 and a sleeve 22. This post and sleeve, and the new bearing means of the invention, will be described in detail hereinbelow. Mounted on the sleeve is a cross bar 24, and on the cross bar are lifting arms 26, having gripping means 28 for gripping a mixing bowl and lifting it, and enabling it to be tilted for emptying it. The general construction of lift truck with the lifting arms, gripping means and means for lifting it on a column are in general known, and the bearing means of the invention are incorporated in the column. The truck is of course pushed from a pickup position to an emptying position.

The lifting step is performed by sliding the sleeve upwardly on the post, and suitable means is provided, indicated in its entirety at 32 for so lifting it. The post 20 has a slot 34 (FIG. 8) for use in lifting the sleeve, but this does not enter into the present invention.

For convenience in orientation and identifying the various parts, the truck 14 is referred to as having a front side 36 and a rear side 38.

The post 20 and sleeve 22 are polygonal in cross sections, preferably square, and arranged with flat sides oriented to the front and back respectively, and also of course to the sides. The column 18 may be of any desired practical height, such as 6 ft., 7 ft., 8 ft., etc., and the sleeve 22 is considerably shorter, such as in the neighborhood of 18–20 in. It will be understood of course that these dimensions are only examples and the invention is not limited to those specific dimensions.

The flat sides of the post and sleeve are shown at 40, 42, respectively, with radiuses 44, 46 between the flat sides, according to convenient manufacturing processes. The post and sleeve are of steel, and in the fabrication of such articles, extreme accuracy is difficult to achieve, but the device of the present invention overcomes the necessity for such extreme accuracy. However the flat sides are uniform in thickness according to accepted steps in fabricating steel, and flat, and the radiuses need not be accurate. The base 16 is also of steel, and the post 20 is welded thereon.

An important feature of the invention is the provision of the bearing means, described hereinbelow, in that they are positioned between the flat sides of the post and sleeve, and the corners need not be accommodated or concerned.

Attention is now directed to FIGS. 2–3 showing bearing means 48 referred to as slide pads which are in the shape of sheets. These slide pads have a limited amount of yieldability, which is relative to the nonyielding and nonflexing character of the steel. The slide pads preferably made of plastic, an example being ultra high molecular weight (UHMW) polyethylene. This material has high lubricating qualities, with the additional advantage of capability of being molded. A preferred form of the slide pads, as shown in FIGS. 2–3, includes a flat sheet 50 having a plurality of pins 52 integral with the sheet, and extending from a flat face thereof. FIGS. 2–3 show six such pins, but other slide pads may include only four such pins, according to the amount of bearing pressure applied thereto, as described again hereinbelow.

The slide pads 48 are placed between the post and sleeve referred to again hereinbelow. As an example of the dimensions involved in the elements, the walls of the post and sleeve may be on the order of 5/32', and the sheet of the slide pad in the neighborhood of 3/64'. The pins 52 may be on the order of 5/16' in diameter, and 3/16' in height. The pins extend into holes 54 (FIGS. 4, 7) and the holes being dimensioned for a slide fit.

The slide pads are confined by the post and sleeve in position between them; and are held in other directions by the pins in the holes 54. The post and sleeve are so dimensioned as to provide the desired space therebetween to receive the slide pads in gripping relation. This relationship is such as to assure alignment of the post and sleeve relative to each other without cocking.

The slide pads 48 have a width to extend only along the flat sides of the post and sleeve, in transverse directions, and at the corners of the column, they are spaced apart from each other, as indicated at 55. The plastic material of the slide pads is incompressible, but it is referred to as having limited yieldability. Each slide pad may spread, in response to great pressure, in transverse or vertical directions, but this spreading is of very minor extent.

FIG. 4 best shows the relationship of the slide pads to the post and sleeve. The slide pads may be of various dimensions, vertically, certain ones being dimensioned for having six pins 52 and others only four. The slide pads may be positioned according to relative size to accommodate relatively greater or lesser bearing pressures applied to them. For example, as will appear best from FIG. 1, the load (mixing bowl 30) bears downwardly on the lifting arms 26, these arms being secured to the cross bar 24, and the latter is secured, as by welding, to the sleeve. This downward pressure produces a bias on the sleeve in counter clockwise direction, as viewed from the right of the truck as indicated by the arrow 56. This produces greater pressure at the upper/-rear and lower/front areas, than at other areas. In this case therefore larger ones of the slide pads 48, i.e. those having six pins, are positioned at those two locations. At the other locations smaller slide pads, i.e. those having four pins, as shown in FIG. 9, at the top of FIG. 8 and bottom of FIG. 10, are utilized. The larger slide pads are of course capable of accommodating such greater pressures.

The provision of the slide pads, as individual and separate items or pieces, renders the arrangement very versatile. They may be placed at desired, selected positions according to the circumstances in each situation.

The slide pads 48, of the kind shown, and described above, are preferred, but the scope of the invention is such as to include a modified form thereof, as illustrated in FIG. 11. In this case the sleeve 22 is shown, having slide pads 56 therein. These slide pads are substantially the length of the sleeve, and have turned over beads 58 at the ends. The slide pads are fitted in the sleeve with the beads 58 engaging the end edges of the sleeve and held thereby against displacement longitudinally. It is also within the scope of the invention to utilize the slide pads 56 of FIG. 7, with the beads 58, and also to provide pins thereon extending into holes in the sleeve.

Another important feature of the invention is that the bearing means, or slide pads, while being extremely simple, accommodate a great range of movement of the sleeve on the post. The relatively short sleeve is movable throughout a great range on the post, including an upper position in which its upper end is substantially at the upper end of the post, and to a lower position where the sleeve is below the middle of the post. The same slide pads, i.e., the same bearing means are active in all positions of the sleeve on the post, and this eliminates the necessity for complicated and elaborate bearing means that were necessary previously to accommodate the sliding movements of the sleeve. In this case the slide pads, extend only throughout the length of the sleeve while various kinds of bearing means heretofore used, extended throughout a substantial portion of the post, and throughout the range of movement of the sleeve thereon. The present construction results in an extremely simple and inexpensive arrangement.

As indicated above the requirement for extreme accuracy in the fabrication of the steel post and sleeve is overcome. In view of the fact that the corners of these members (FIG. 5) are rounded, the only requirement for any accuracy is in the flat sides 40, 42 and providing such flat sides is a relatively simple fabricating step. The flat sheets of the slide pads can be easily provided, these members being moldable, and the flat sheet part thereof may easily be held within reasonable tolerances to provide uniformity in the thickness of the sheet. Such a sheet of the dimensions mentioned may bend or buckle, but when confined between the post and sleeve they are of course held securely flat, the steel members readily producing that effect.

I claim:

1. A truck for grasping a load, moving it vertically, and holding it in selected positions in its vertical movement, and capable of being moved along a floor for transporting the load, comprising, a base directly engaging the floor, a column on the base and including a post mounted on the base and a sleeve slideably mounted on the post, lifting arms on the sleeve capable of holding the load, the sleeve and post being of complementary polygonal shape in cross section, and slide pads separate from and independent of the post and sleeve, and of limited yieldability interposed between the post and sleeve and having elements positioned at least adjacent the ends of the sleeve, said slide pads constituting bearing means, the slide pads being separate from each other and positioned flat against the sides of the post and sleeve, and adjacent ones of the slide pads, at each corner of the post and sleeve, being spaced apart circumferentially.

2. A truck according to claim 1 wherein, the sleeve is substantially shorter than the post, and is movable between a lower position in which its lower end is at the lower portion of the post, and an upper position in which its upper end is substantially at the upper end of the post, and the slide pads are carried by the sleeve and constitute the sole means receiving and transmitting bearing thrust between the post and the sleeve.

3. A truck according to claim 1 wherein, the slide pads on each side of column include separate parts at the top and bottom.

4. A truck according to claim 1 and wherein, the slide pads are confined between the post and the sleeve, and including, means detachably interlocking the sheets to the sleeve.

5. A truck according to claim 4 wherein, the interlocking means includes holes in the sleeve and pins on the slide pads loosely fitted in the holes.

6. A truck according to claim 4 wherein, the slide pads extend substantially the length of the sleeve, and the interlocking means includes beads on the slide pads extending over and engaging the ends of the sleeve.

7. A truck according to claim 1 wherein, the truck, including the column, has a front and a rear side, the post and sleeve are square in cross section, and have flat sides directed to the front and rear respectively, the slide pads extend horizontally throughout substantially the entire dimension of the flat sides of the post and sleeve, the post and sleeve are of inflexible steel, the slide pads are of plastic and relatively thin, the post, sleeve, and slide pads are so dimensioned that the post and slide pads are confined to the flat position without voids or spaces between the slide pads and the post and sleeve, and the slide pads are of limited yieldability but incompressible, and constitute sole means receiving and transmitting bearing thrust between the post and the sleeve.

8. A truck according to claim 7 wherein, the slide pads at the front side and top, and the rear side and bottom, are larger than the remaining slide pads to receive the relatively greater bearing load.

9. A truck according to claim 7 wherein, the slide pads possess lubricating qualities.

* * * * *